United States Patent [19]

Schnell

[11] Patent Number: 4,466,603

[45] Date of Patent: Aug. 21, 1984

[54] METHODS AND APPARATUS FOR PRODUCING STACKS OF SHEETS

[75] Inventor: Gerhard Schnell, Neuffen, Fed. Rep. of Germany

[73] Assignee: bielomatik Leuze GmbH + Co., Fed. Rep. of Germany

[21] Appl. No.: 263,070

[22] Filed: May 13, 1981

[30] Foreign Application Priority Data

May 17, 1980 [DE] Fed. Rep. of Germany ..... 3018987

[51] Int. Cl.[3] ..... B65H 39/075

[52] U.S. Cl. ..... 270/58; 270/21.1

[58] Field of Search ..... 270/58, 53, 21.1; 493/61-62, 76, 143, 237, 343, 346, 361, 378

[56] References Cited

U.S. PATENT DOCUMENTS

| | | | |
|---|---|---|---|
| 1,253,247 | 1/1918 | Jennings | 270/58 |
| 2,879,991 | 3/1959 | Pitner | 270/58 |
| 2,973,199 | 2/1961 | Biel | 270/53 X |
| 3,224,306 | 12/1965 | Hawley | 270/58 X |
| 3,427,655 | 2/1969 | Woodside | 270/58 X |
| 3,441,267 | 4/1969 | Carstens | 270/58 X |
| 4,280,690 | 7/1981 | Hill | 270/58 |

FOREIGN PATENT DOCUMENTS 1012155 7/1952 France .

*Primary Examiner*—A. J. Heinz

*Attorney, Agent, or Firm*—Steele, Gould & Fried

[57] ABSTRACT

An apparatus for processing and conveying indexed stacks of sheets produced from wide stock, comprising: a cutting station for successively severing the stock lengthwise to produce parallel rows of side-by-side layers; a lengthwise conveyor for conveying the parallel rows of layers in a conveying direction; a spacing station disposed downstream of the cutting station for spacing the layers apart from one another in the direction transverse to the conveying direction; an index punching station disposed downstream of the spacing station and having a row of punches for removing parts of the lengthwise edges of at least some of the layers, at least some of the layers in each row being different from adjacent layers in the row; and, a transverse conveyor, adapted for incremental stepped conveying, disposed downstream of the index punching station, for receiving the spaced, punched layers and for producing stacks of indexed layers as the conveyor steps from one end of the row to the other. The apparatus may further comprise: a binding punching station disposed upstream of the index punching station; a printing station for printing an index inscription on a top sheet of the layers of sheets, disposed upstream of the index punching station; and, a laying-on station for an intermediate sheet, disposed upstream of the printing station.

7 Claims, 2 Drawing Figures

METHODS AND APPARATUS FOR PRODUCING STACKS OF SHEETS

BACKGROUND OF THE INVENTION

1. Field of the Invention

The invention relates to a method and apparatus for producing stacks of sheets and in particular, stacks of sheets having a plurality of layers one above the other and which are provided with punched indexing.

2. Description of Prior Art

A method and apparatus of the kind specified have already been suggested in which the layers of sheets, lying one beside the other in several batches, have an indexing punch for producing the "finger holes" which has punches which can be extruded in succession as required. Collection is carried out at a collecting station at which a complete stack of sheets or block is formed for each batch.

SUMMARY OF THE INVENTION

The object of this invention is to further simplify and improve the method and apparatus described above, by methods and apparatus as described hereinafter.

With this apparatus it is unnecessary to use an indexing punch with punches which can be changed over as required, since each batch has its own punch which always produces the same punching. The layers of sheets with different index-punchings are joined together by being transversely conveyed away at the collecting station. Normally one transverse conveying cycle is performed per approach conveying cycle, so that the same number of indexes is formed as the number of batches conveyed to the collecting station one beside the other. This is particularly advantageous for spirally bound school notebooks which are subdivided into different areas for different subjects, for instance, 5—subject notebooks.

However, if, for instance, operations are carried out with 6 batches (6 stacks of sheets one beside the other) and only 3 indexes one above the other are required, each pair of adjacent index punches can perform identical punchings. The result is a block with only three indexes, for the thickness of all six batches. A double block can be produced by moving the transverse conveyer one step onwards only at every second step of the approach conveyer, so that every time twice the number of batches are collected on one stack. If, on the contrary, blocks with only half the thickness of the total batches are required, with identical pairs of adjacent index punches the transverse conveyer can be moved onwards by two steps for each approach conveyer step.

Furthermore, with an index punch which can perform a number of kinds of index punchings in succession by, for instance, being moved forwards or backwards by one "index step" alternately in the conveying direction during successive punchings, a double or multiple number of index subdivisions can be produced, corresponding to the number of batches one beside the other. In that case also the transverse conveyer would be actuated only at every second, third, etc., step of the approach conveyer.

It must therefore be recognized that the invention enables numerous required versions of index of similar punchings to be carried out using a very simple apparatus. Preferably the register punching takes place after the strip of layers of sheets have been separated into the individual batches. Advantageously also the individual batches are moved somewhat to a transverse distance from one another before the index-punching, to prevent the index punch from cutting into the back of the adjacent layer of sheets. If this is not essential or done in accordance with the punching arrangements, however, the index-punchings can be made in the still cohesive strip of layers of sheets.

The binding punchings required for spirally or comb-bound blocks are preferably carried out on individual batches before separation. Very advantageously such punchings are carried out on the individual layers of sheets, since as a rule the possible punching height is smaller than the thickness of the finished block or stack. To characterize the indexes, complete intermediate sheets with printed inscriptions can be laid on even before the index-punching, so that such intermediate sheets are also furnished with precisely aligned punchings. Additionally or alternatively, a printing station can be provided which makes the printed indexing inscriptions, for instance, for an alphabetical or monthly index.

Another advantage of the invention in many cases is that the collecting station produces a deflection in the flow of material, and this is often desirable. The blocks leave the collecting station lying one behind the other, so that the individual batches are automatically guided together into a common path. However, if further conveying in the same direction should be necessary or desirable, another longitudinal conveyer, offset by one width of the belt, having a conveying direction parallel with the approach conveying direction, can be provided alongside the collecting station.

Further advantages and features of preferred embodiments of the invention can be gathered from the claims, the detailed description and the drawings.

DETAILED DESCRIPTION OF THE PREFERRED EMBODIMENTS

Figure 1:
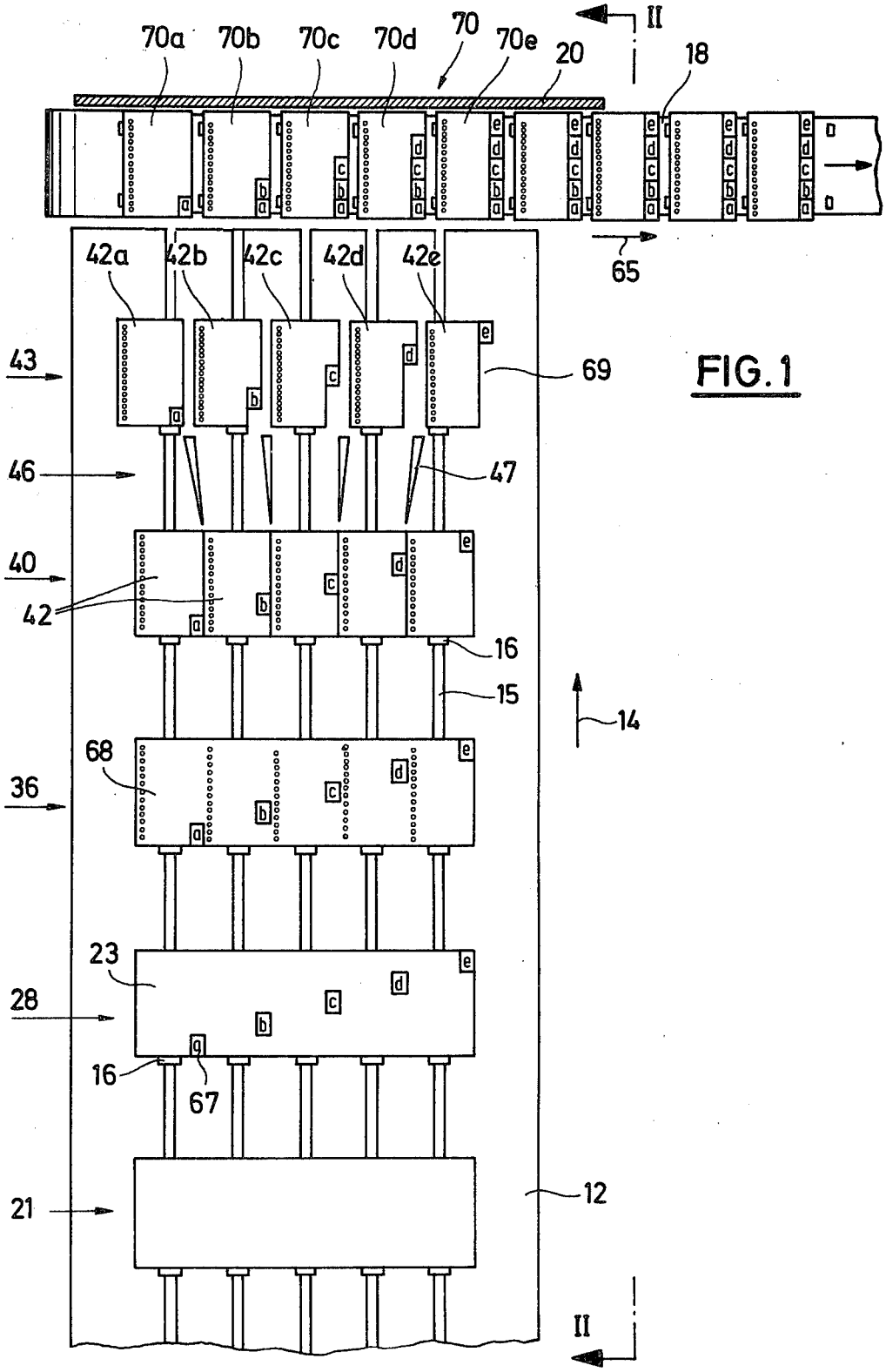
FIG. 1 is a diagrammatic plan view of the apparatus, taken along the line I—I in FIG. 2.
Figure 2:
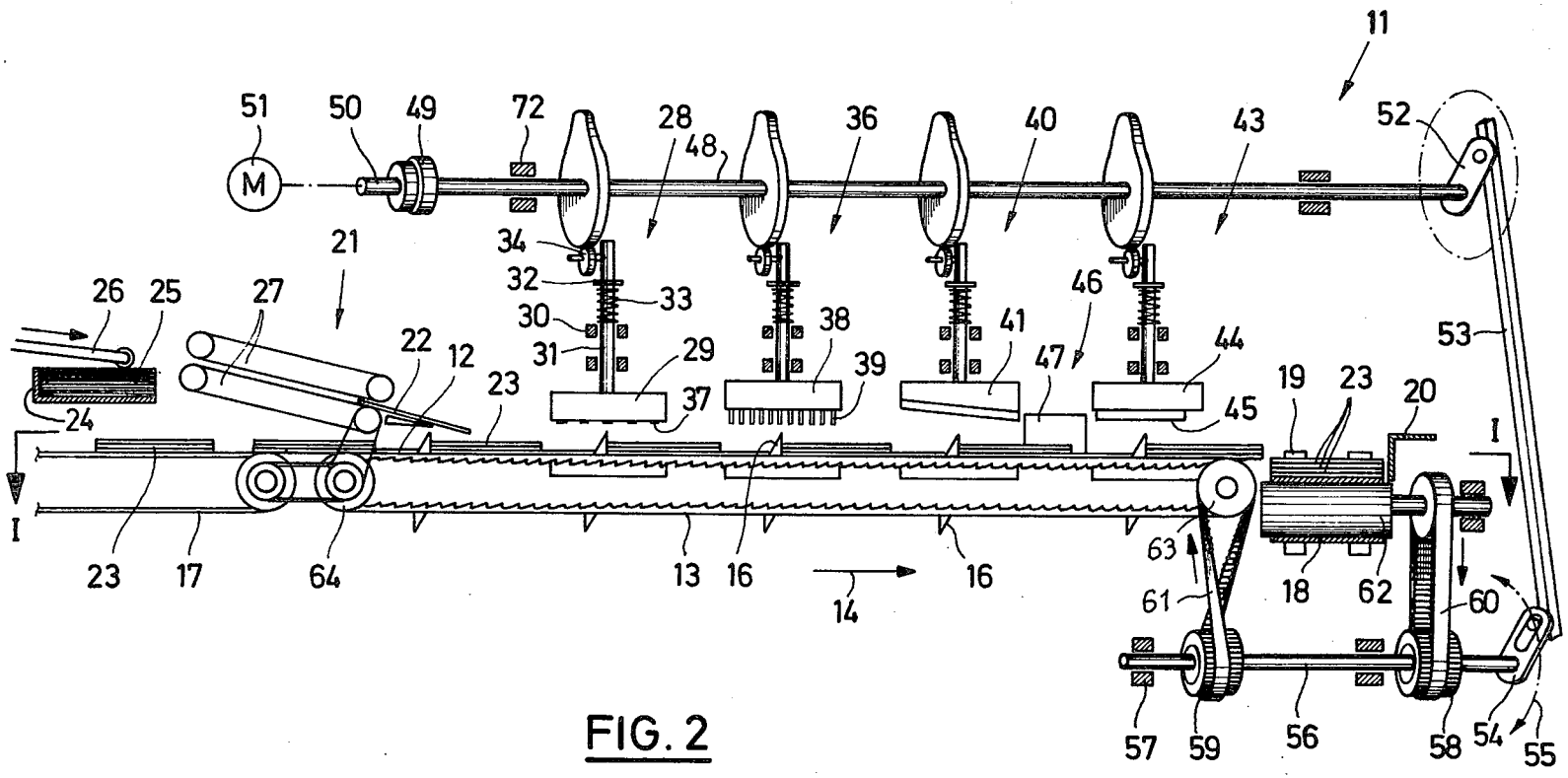
FIG. 2 is a diagrammatic partial section, taken along the line II—II in FIG. 1.

The apparatus illustrated in the drawings is normally forms a portion of a larger apparatus in a plant for producing blocks or notebooks with a spiral or comb-type binding. The apparatus 11 has a horizontal table 12 having slots 15 which extend longitudinally in the conveying direction 14 and through sheets and stacks of sheets. Thrust elements 16 thrust elements 16 engage which are disposed on toothed belts 13 or chains which run around along the slots 15 below the table 12. Disposed upstream of the table 12 in the conveying direction is an approach conveyer belt 17. A collecting and removal conveyer belt 18 which extends transversely of the conveying direction 14 is disposed downstream of the table 12 in the conveying direction. The belt 18 has thrust members 19 projecting from its surface. The collecting and removal conveyer belt 18 is so arranged that its edge extends transversely in front of the end of the table 12, an abutment strip 20 extending parallel with the belt 18 being disposed on its side remote from the table.

Various processing stations are disposed along the table in the conveying direction. A laying-on station 21 enables intermediate sheets 22 to be laid on a stack of sheets 23 which, pushed by the thrust elements 16, moves along the conveying direction 14 on to the table. In the example illustrated, the laying-on station comprises a stack holder 24, which receives a stack 25 of the intermediate sheets, a drawing-off gripper 26 of conventional construction which draws each individual sheet off the stack, and a run of belts 27 with top and bottom belts, which convey the intermediate sheet 22 at an inclination downwards on to the layer or stack of sheets 23.

Disposed downstream of this in the conveying direction is a printing station 28 having at least one printing punch 29 which can be moved up and down via a tappet 31 vertically guided in bearings 30. The printing punch is retained in the top position by a spring 33 engaging with a collar 32 of the tappet and can be actuated by a cam 35 via a roller 34 pivotably mounted on the tappet.

A binding punching station 36 has, instead of the printing punch 29 with printing elements 37 disposed offset and one beside the other, a number of parallel rows of pin-shaped punches 39 (five parallel rows in the example illustrated) on a punching member 38. In the example illustrated a longitudinal cutting station 40 has at least four parallel and possibly inclined blades 41 which are aligned in the conveying direction and which cut apart into individual batches 42 (rows) the stack of sheets 23 up to then cohesive over the whole width. In this example, an index-punching station 43 has on a punching member 44 four punches 45 which have the shape of strips of different length extending longitudinally in the conveying direction. In their drives for their vertical up-and-down reciprocating movement, the four stations 28, 36, 40, 43 are constructed in the same manner as described in relation to the station 28. Disposed between the longitudinal cutting station 40 and the index-punching station 43 is a spacing-out station 46 which in the present example has the wedge-shaped guides 47 which are shown in FIG. 1 and which move the batches or stacks 42 apart from one another by the time they reach the longitudinal cutting station 40. The stations 28, 36, 40, 43 are driven via a continuous horizontal shaft 48 which is connected via a clutch 49 to the joint synchronous shaft 50 of the whole machine, which is driven by a motor 51 (indicated diagrammatically). The shaft is mounted in bearings 72 secured to the machine and bears, in addition to the cams 35 for the stations, at its free end a crank arm 52 with which a thrust rod 53 is articulated which is pivotably mounted on a pivoting arm 54. When the crank arm 52 rotates, the longer pivoting arm 54 (as indicated by arrow 55) is pivoted backwards and forwards by an angle preferably adjustable via a slot and transmits such pivoting movement to its supporting spindle 56, which is mounted in bearings 57 on the machine frame. Disposed on the spindle 56 are two drive wheels 58, 59 for toothed belts 60,61, which on the one hand drive the deflecting and driving roller 62 of the collecting and removal conveyer belt 18, and on the other hand one deflecting and driving roller 63 of the toothed belt 13 with the thrust members 16. The drive wheels 58, 59 are connected via freewheel couplings, operative in opposite directions of rotation, to the spindle 56, so that every time one drive wheel is entrained in one direction of rotation, the other drive wheel is entrained in the other direction of rotation. As a result, every time one drive wheel is stationary when the other moves. The driving parts disclosed up to date have been shown slightly in perspective, to clarify the drawing, although they are disposed parallel with the conveying direction.

The approach conveyer belt 17 and the run of belts 27 of the laying-on station 21 can be driven, for instance, via the second deflecting roller 64 of the toothed belt 13 via belts or chains, with the interposition of a transmission if necessary.

Using the apparatus described, the method according to the invention can be performed as follows. When the shaft 48 rotates, layers of sheets 23 are conveyed on to the table 12 by the approach conveyer belt 17 and are then conveyed step-by-step in the conveying direction 14 by the thrust members 16 running in the slots 15. As a result, the crank arm 52 moves the thrust rod 53 upwards and downwards and confers a horizontally reciprocating pivoting movement on the shaft 56 which, when the pivoting arm 54 makes a downward movement, entrains the drive wheel 58 and therefore entrains the collecting and removal conveying belt 18 one step in the transverse conveying direction perpendicularly to the conveying direction 14, while when the pivoting arm 54 makes an upward movement, the coupling of the drive wheel 59 responds and advances the toothed belt 13 by one step via the twisted toothed belt 61. At the laying-on station 21 the layer of sheets 23, cut to the correct length, but consisting of strips still cohesive in the transverse direction, is given an intermediate sheet 22 which is conveyed to the layer of sheets by the draw-off gripper 26 and the run of belts 27. The intermediate sheet can be of a different thickness or color from the other sheets of the layer.

At the printing station 28, when the projecting member 66 of the cam 35 acts on the roller 34 to depress the tappet 31, the member 29 with the individual printing punches 37 is applied and makes the, for instance, color markings 67 shown in FIG. 1 (letters a to e in the example) at the places which are subsequent to form the visible part of the index. However, the printed inscription can also be made on the normal sides of the layer of sheets. In that case the laying-on station 21 could be eliminated. If ready-printed intermediate sheets are applied or no printed inscription is produced, the printing station might be eliminated. At the same time the punching member 38 of the binding punching station, situated one conveying step further, descends; in this example the five parallel rows of round or elongate binding punches 68 shown in FIG. 1 are used. For this purpose the punches 39, as at all the other stations, co-operate with matching counter-pressure plates or matrices. The binding punching station might be eliminated if, instead of a spirally or comb-bound block, only layers are to be produced which are either left without binding or are to be subsequently stapled together with a different binding.

Also at the same time the layer of sheets 23 is separated into the individual batches 42 by the upward and downward movement of the blades 41 at the longitudinal cutting station disposed a further step in the conveying direction. After-cutting might also be performed at the two outer edges. Suitable hold-down means which may be required to produce a clean cut are not illustrated, since they are familiar prior art.

On the next conveying step the individual batches 42 are guided apart laterally by the spacing-out station, so that at the index-punching station 43 the punches 45 do not cut into the back of the adjacent layer. FIG. 1 shows how the index punches 45 produce each of the punchings 69 of different lengths below the markings 67—i.e., as shown in FIG. 1 the batch on the left has no punching 69, the following batches each having a larger punching 69 than the preceding ones.

Disposed another conveying step further on is a collecting point 70 which is formed on the collecting and removal conveying belt and at which the individual batches are laid or pushed on to any batches already lying there. In the example illustrated, for each conveying step in the conveying direction 14, the belt 18 also moves by one conveying step further, so that every time only one batch, namely the left-hand batch 42*a*, lies in the left-hand compartment 70*a* of the collecting point, while in the adjoining collecting point 70*b* to the right the associated batch 42*b* lies on the batch 42*a*, etc. Finally, at the station 70*e* all the five stacks or batches 42*a*—*e* lie on one another and form a stack of sheets of five individual layers, each of which has its own index marking visible from above (for example, a 5-subject notebook). A binding station can be provided following the collecting and removal conveyer belt 18.

I claim:

1. An apparatus for producing and conveying indexed stacks of sheets, processed from layers of wide stock, comprising:

cutting means for successively severing the stock lengthwise to produce parallel rows of side-by-side batches of layers, the layers having lengthwise binding edges and index edges opposite one another and parallel to a conveying direction;

lengthwise conveying means for conveying the parallel rows of batches of layers in the conveying direction;

spacing means disposed downstream of the cutting means for spacing the batches of layers in each row apart from one another in a direction transverse to the conveying direction;

index-punching means disposed downstream of the spacing means and having a row of adjustable punches for simutaneously removing parts of at least one of the lengthwise index edges of the layers in at least some of the batches in each row without damaging the lengthwise binding edges of layers in adjacent but spaced batches, the punches being adjusted so that at least some of the batches of layers in each row are punched differently from adjacent batches of layers in the same row by the index-punching means; and, transverse conveying means, adapted for incremental stepped conveying, disposed downstream of the index-punching means, for receiving the spaced, differently-punched batches of layers and for producing stacks of indexed sheets from the batches of layers in each row as the conveyor steps from one end of each row to the other.

2. An apparatus according to claim 1, further comprising:

a binding-punching station disposed upstream of the index-punching station, for forming aligned rows of apertures along the binding edges into which binding may be inserted;

a printing station disposed upstream of the binding-punching station for printing an index inscription on the top layer of each batch of layers; and, a laying-on station disposed upstream of the printing station for adding an intermediate layer to each batch.

3. An apparatus according to claim 2, further comprising means for synchronously driving the cutting means, the lengthwise conveying means, the index-punching means, the transverse conveying means, the binding-punching station, the printing station and the laying-on station.

4. The apparatus of claim 1, further comprising means for synchronously driving the cutting means, the lengthwise conveying means, the index-punching means and the transverse conveying means.

5. An apparatus according to claim 1, further comprising a binding-punching station disposed upstream of the index-punching station having means for simultaneously punching binding perforations along the binding edges of the layers of each row.

6. An apparatus according to claim 1, further comprising a laying-on station disposed upstream of the index-punching means, for adding an intermediate layer to each batch of layers.

7. An apparatus according to claim 1, further comprising a printing station disposed upstream of the index-punching station, for printing an index inscription on the top layer of each batch of layers.

* * * * *